US005568349A

United States Patent [19]

Kowalewski

[11] Patent Number: 5,568,349

[45] Date of Patent: Oct. 22, 1996

[54] APPARATUS AND METHOD FOR CONTROLLING A RELAY DEVICE

[75] Inventor: Rolf E. Kowalewski, Palatine, Ill.

[73] Assignee: Motorola, Inc., Schaumburg, Ill.

[21] Appl. No.: 416,253

[22] Filed: Apr. 4, 1995

[51] Int. Cl.[6] ..... H01H 47/04

[52] U.S. Cl. ..... 361/154; 361/170; 307/116

[58] Field of Search ..... 361/152–156, 361/160, 170, 194; 307/115, 116, 143

[56] References Cited

U.S. PATENT DOCUMENTS

| | | | |
|---|---|---|---|
| 3,852,646 | 12/1974 | Mason | 361/154 |
| 4,336,564 | 6/1982 | Wisniewski et al. | 361/154 |
| 4,345,564 | 8/1982 | Kawamura et al. | 361/154 |
| 4,434,450 | 2/1984 | Gareis | 361/152 |
| 4,516,185 | 5/1985 | Culligan et al. | 361/154 |
| 5,018,366 | 5/1991 | Tanaka et al. | 361/154 X |
| 5,085,574 | 2/1992 | Wilson | 431/6 |
| 5,146,386 | 9/1992 | Learned | 361/91 |
| 5,210,756 | 5/1993 | Kummer et al. | 395/182.02 |

*Primary Examiner*—Fritz Fleming
*Attorney, Agent, or Firm*—Richard A. Sonnentag; Daniel C. Crilly

[57] ABSTRACT

A relay device (103) having a coil (144) and a set of contacts (146, 147) employs an apparatus (100) and method (200) for drawing current through the coil (144) to close, and maintain closure of, the set of contacts (146, 147). A first terminal of the coil (144) is coupled to a power supply (101) and a second terminal of the coil is coupled to a holding circuit (108, 115, 126) that establishes a first current through the coil (144). The second terminal of the coil (144) is also coupled to a closing circuit (112) that establishes a second current through the coil (144), wherein the first current and the second current together are at least sufficient to close the set of contacts (146, 147) and the first current is sufficient to maintain closure of the closed set of contacts (146, 147). A control circuit (118, 128) is coupled to the closing circuit (112) and the holding circuit (108, 115, 126) to remove the second current after the set contacts (146, 147) are closed.

4 Claims, 2 Drawing Sheets

APPARATUS AND METHOD FOR CONTROLLING A RELAY DEVICE

FIELD OF THE INVENTION

The present invention relates generally to relay devices and, in particular, to an apparatus and method for controlling a relay device.

BACKGROUND OF THE INVENTION

Relay devices are known electrically controllable, high current switches that are used in a variety of applications. In one such application, relay devices are typically used to couple direct current power supplies to base station transmitters at base sites of communication systems. In another application, relay devices may be used to couple a high current supply to a loading circuit, for example in a power transmission system or an automobile starter circuit.

Relay devices are known to comprise a coil and a set of contacts. In a typical configuration, the relay device is open—thereby prohibiting current flow—when the relay contacts are open, and closed—thereby permitting current flow—when the relay contacts are closed. Consequently, an electric control circuit is used to open and close the relay contacts (i.e., control the relay device) depending on whether the relay device is to be opened or closed, respectively. In a typical application, a relay device is controlled electrically to allow a loading circuit to be enabled and disabled—for example, when engaging and disengaging, respectively, the starter of an automobile engine.

In general, relay device operation occurs as follows. When an initially open relay device is to be closed, the control circuit enables a transistor circuit coupled to the relay coil. The transistor circuit enables an amount of current specified by the relay manufacturer to flow through the relay coil from a power supply coupled to the relay coil. The current in the relay coil induces a magnetic field around the coil. The magnetic field provides the force necessary to close the relay contacts, thereby allowing the relay contacts to provide a current path between the power supply and a loading circuit. When the relay device is to be re-opened, the control circuit disables the transistor circuit to remove the current in the relay coil, thereby removing the magnetic field and opening the relay contacts. Therefore, in the prior art, whenever the relay is closed, the current necessary to close the relay contacts continually flows through the relay coil and is determined by the resistance of the relay coil. In a typical situation, the current necessary to close the relay contacts is significant (e.g., 500 milliamps) and results in substantial power dissipation (e.g., 13 Watts at 26 Volts) in the relay coil, especially since the relay coil is not typically heat sunk and is physically small (e.g., 7.5 centimeters long by 5 centimeters in diameter). Excessive dissipation in the relay coil reduces the mean-time-to-failure of the relay coil, thereby decreasing the reliability of the relay device and, often, the loading circuit coupled to the relay device.

Therefore, a need exists for a method and apparatus for drawing current through a relay device that closes and maintains closure of the relay device while minimizing power dissipation in the relay coil. Further, such a method and apparatus that provide redundant control of the relay device would be an improvement over the prior art.

DESCRIPTION OF A PREFERRED EMBODIMENT

The present invention provides an apparatus and method for controlling a relay device having a coil and a set of contacts. A first terminal of the coil is coupled to a power supply and a second terminal of the coil is coupled to a holding circuit that establishes a first current through the coil. The second terminal of the coil is also coupled to a closing circuit that establishes a second current through the coil, wherein the first and second currents together are at least sufficient to close the set of contacts and wherein the first current is sufficient to maintain closure of the closed set of contacts. A control circuit is coupled to the closing circuit and the holding circuit to remove the second current after the set of contacts are closed. By drawing current through the coil of the relay device in this manner, the present invention controls the relay device by allowing the relay device to remain closed, while lowering the dissipation in the relay coil compared to prior art techniques due to the presence of the holding current only in the coil after closure. By reducing the dissipation in the relay coil, the present invention extends the usable life of the relay device and reduces the probability of failure of the relay device due to thermo-mechanical fatigue.

Figure 1:
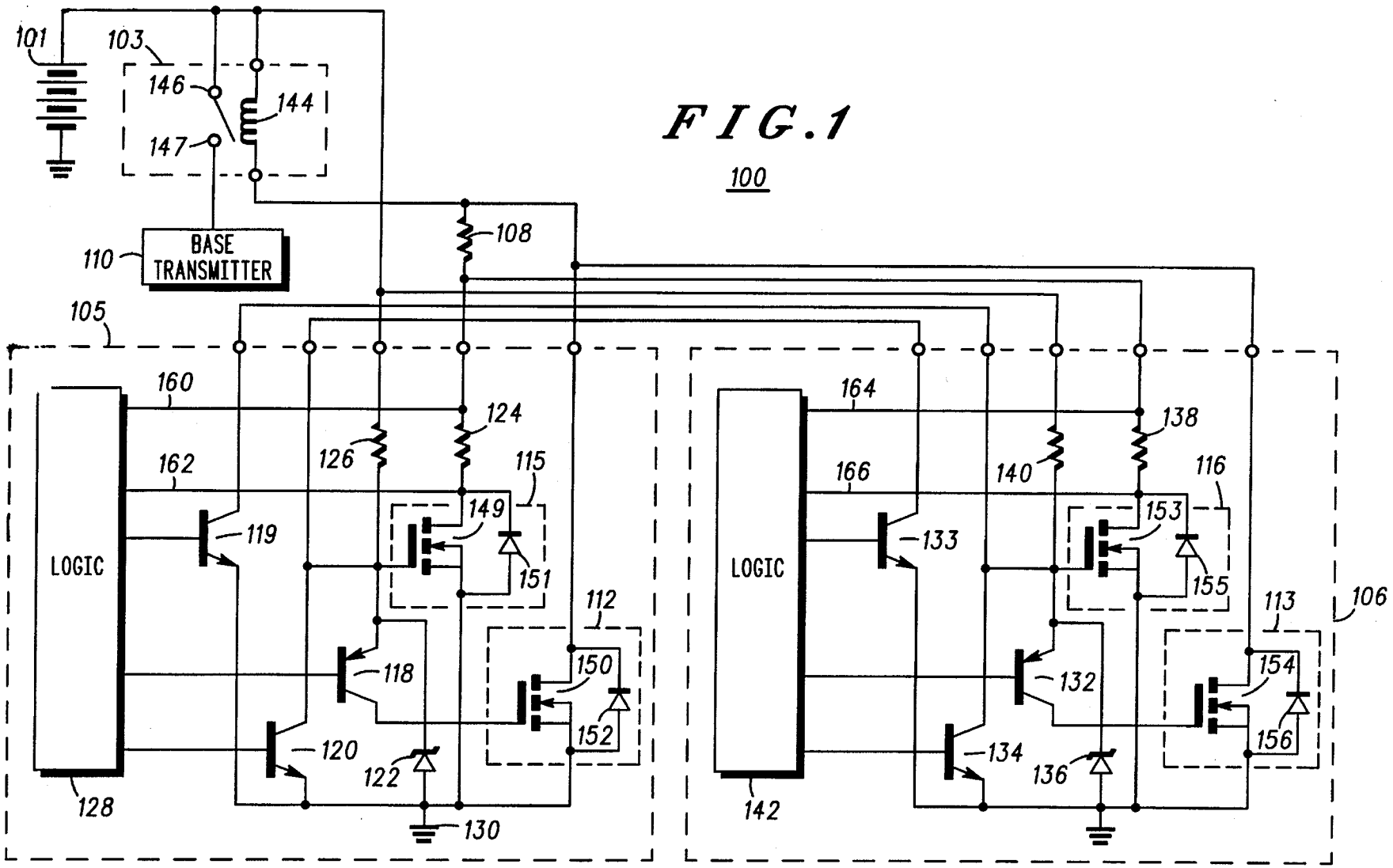
FIG. 1 illustrates a base site containing a redundant relay driver circuit for drawing current through a relay device in accordance with a preferred embodiment of the present invention.
Figure 2:
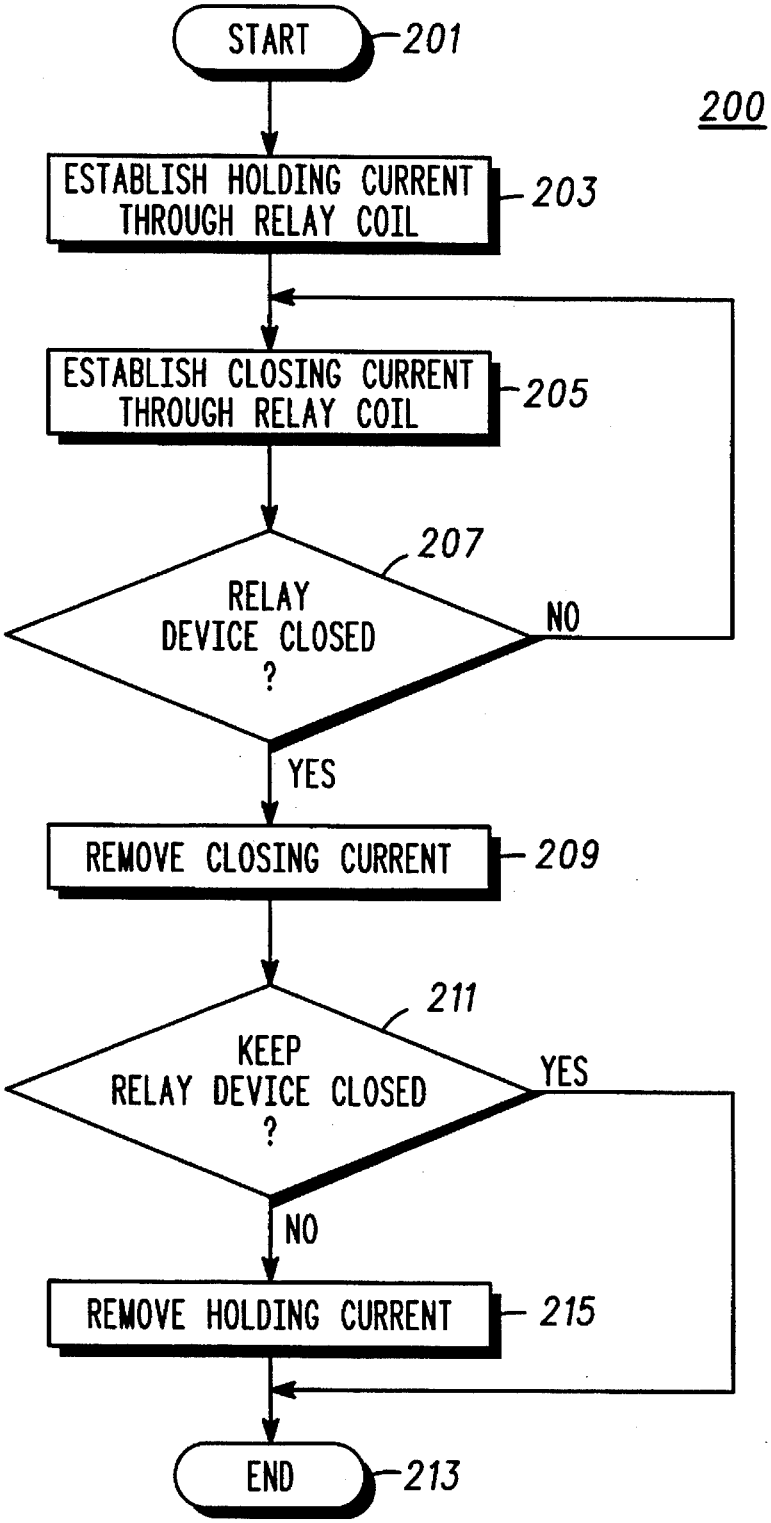
FIG. 2 illustrates a logic flow diagram of steps executed to draw current through a relay device in accordance with the present invention.

The present invention can be more fully understood with reference to FIGS. 1 and 2. FIG. 1 illustrates a base site 100 containing a redundant relay driver circuit for drawing current through a relay device 103 in accordance with a preferred embodiment of the present invention. The base site 100 includes a power supply 101, the relay device 103, relay driver circuits 105, 106, and a base station transmitter 110. Relay driver circuits 105, 106 together comprise the redundant relay driver circuit. The power supply 101 preferably comprises a direct current (DC) supply or a battery. However, in an alternate embodiment, the power supply 101 might comprise an alternating current (AC) supply with a DC output. The base station transmitter 110 is well-known and provides a load to the power supply 101 when the relay device 103 is closed. Therefore, although the present invention will be described with respect to its operation at a base site 100 of a communication system, the present invention is equally applicable to any scenario where the relay device 103 is used to couple the power supply 101 to a load.

As is known, the relay device 103 includes a coil 144 and a set of contacts 146, 147. In a typical configuration, the contacts 146, 147 of the relay device 103 remain open until a specified current is drawn through the coil 144. The specified current is typically determined by the operational voltage of the relay device 103 and the resistance of the relay coil 144 as specified by the relay device manufacturer. When the specified current flows through the coil 144, the current in the coil 144 produces a magnetic field with enough force to close the contacts 146, 147, thereby allowing current to flow from the power supply 101 to the load (e.g., base station transmitter 110) coupled to the power supply 101 via the relay device 103.

As shown, the relay driver circuits 105, 106 are substantially identical and share a common resistor 108. Each relay driver circuit 105, 106 is a preferred apparatus for drawing current through the relay coil 144 to allow the relay coil 144 to close, and maintain closure of, the relay contacts 146, 147. Relay driver circuit 105 preferably comprises a closing amplifier: circuit 112, a holding amplifier circuit 115, a plurality of switching transistors 118–120, a bias resistor 126, a current-sensing resistor 124, a zener diode 122, and a logic control circuit 128. Similarly, relay driver circuit 106 preferably comprises a closing amplifier circuit 113, a holding amplifier circuit 116, a plurality of switching transistors 132–134, a bias resistor 140, a current-sensing resistor 138, a zener diode 136, and a logic control circuit 142. In the preferred embodiment, relay driver circuit 106 is used for redundancy purposes to reduce the probability of relay device drop-out due to a failure in relay driver circuit 105.

In the preferred embodiment, each of the closing amplifier circuits 112, 113 comprises a three-terminal amplifying device, such as a transistor 150, 154, and a diode 152, 156, wherein the anode of the diode 152, 156 is coupled to a supply terminal of the closing transistor 150, 154 and the cathode of the diode 152, 156 is coupled to a return terminal of the closing transistor 150, 154. The diode 152, 156 is preferably collocated within the closing transistor package and protects the closing transistor 150, 154 from experiencing high reverse voltages due to the instantaneous current change in the relay coil 144 when either the holding amplifier circuit 115, 116 or the closing amplifier circuit 150, 154 is enabled. In an alternate embodiment, the diode (e.g., 152) might be coupled directly in parallel with the relay coil 144. Similar to the closing amplifier circuits 112, 113, each of the holding amplifier circuits 115, 116 preferably comprises a three-terminal amplifying device, such as a transistor 149, 153, and a diode 151,155, wherein the anode of the diode 151, 155 is coupled to a supply terminal of the holding transistor 149, 153 and the cathode of the diode 151, 155 is coupled to a return terminal of the holding transistor 149, 153. Diodes 151, 155 perform the same function as diodes 152, 156. The logic control circuit 128 preferably comprises a microprocessor that provides control signals to the switching transistors 118–120.

Operation of the base site 100 with a single, isolated relay driver circuit 105 occurs as follows in accordance with the invention. The logic control circuit 128 enables the holding amplifier circuit 115 by disabling (i.e., switching off) switching transistor 120 via a control signal. Once switching transistor 120 is disabled, the voltage at the control terminal of the holding transistor 149 rises to the zener voltage (e.g., 12 volts) of the zener diode 122, coupled between the transistor's control terminal and the signal return 130, in response to the current flowing through the bias resistor 126. The value of the holding current established through the holding transistor 149 and, equivalently, through the relay coil 144 is determined by the power supply voltage (e.g., 26 volts), the resistance of the relay coil 144, and the resistance of the current-limiting resistor 108 coupled between the transistor's supply terminal, via the current-sensing resistor 124, and one terminal of the relay coil 144. Thus, the holding amplifier circuit 115, the bias resistor 126, and the current-limiting resistor 108 together comprise holding means for establishing the holding current through the relay coil 144. Techniques for establishing currents in transistor devices are well-known, thus no further discussion will be presented except to facilitate an understanding of the present invention. In a preferred embodiment, the holding current is approximately 250 milliamps and is established by setting the resistance of the current-limiting resistor 108 approximately equal to the resistance of the relay coil 144 (e.g., 52 ohms).

Once established, the holding current is verified by the logic control circuit 128. The logic control circuit 128 measures the voltages at both sense terminals 160, 162 of the current-sensing resistor 124 to determine whether the current flowing through the holding transistor 149, and equivalently the relay coil 144, is equivalent to the desired holding current. In a preferred embodiment, the resistance of the current-sensing resistor 124 is small (e.g., 10 ohms) compared to the total series resistance of the current-limiting resistor 108 and the relay coil 144. If the measured voltage at the upper sense terminal 160 is approximately equal to the voltage (e.g., 2.6 Volts) corresponding to the desired holding current while the voltage at the lower sense terminal 162 is approximately zero Volts, then the logic control circuit 128 determines that the holding circuitry 108, 115, 126 is operable. However, if the voltages at both sense terminals 160, 162 are equal, then either the holding means 108, 115, 126 or the relay device 103 may be defective. For example, if the voltages at both sense terminals 160, 162 are greater than 2.6 Volts, then the holding transistor 149 might be open-circuited; whereas, if the voltages at both sense terminals 160, 162 are approximately zero Volts, then the relay coil 144 or current-limiting resistor 108 might be open-circuited. In the preferred embodiment, the logic control circuit 128 routinely (e.g., every few minutes) verifies the holding current of the active relay driver circuit 105.

After establishing the holding current in the relay coil 144, the logic control circuit 128 determines whether the relay device 103 is to be closed. When the logic control circuit 128 determines that the relay device 103 is to be closed, the logic control circuit 128 establishes the closing current in the relay coil 144 via the closing amplifier circuit 112. The logic control circuit 128 enables the closing amplifier circuit 112 by enabling (i.e., switching on) switching transistor 118 via a control signal. Once switching transistor 118 is enabled, the voltage at the control terminal of the closing transistor 150 rises to approximately the zener voltage of the zener diode 122 (i.e., the zener voltage less the saturation voltage of switching transistor 118). The value of the closing current established through the closing transistor 150 and the relay coil 144 is determined by the power supply voltage and the resistance of the relay coil 144. Thus, the closing amplifier circuit 112 comprises closing means for establishing a closing current through the relay coil 144 that, together with the holding current, is at least sufficient to close the relay contacts 146, 147. In a preferred embodiment, the closing amplifier circuit 112 alone draws sufficient current through the relay coil 144 to close the relay contacts 146, 147. Thus, in the preferred embodiment, the closing current is greater than the holding current. However, in an alternate embodiment, the closing amplifier circuit 112 might be modified—for example, to include a resistor similar to the current-limiting resistor 108 coupled to the holding amplifier circuit 115—to draw an amount of current equal to the difference between the holding current and the current required to close the relay contacts 146, 147. Thus, depending on the selected holding current, the holding current might be greater than or equal to the closing current, although still less than the current required to close the relay contacts 146, 147.

After the closing current has been established and the relay contacts 146, 147 have closed, the logic control circuit 128 disables the closing transistor 150 by disabling switching transistor 118. In a preferred embodiment, the logic control circuit 128 enables the closing transistor 150 for a predetermined length of time (e.g., 100 milliseconds) sufficient to insure closure of the relay contacts 146, 147.

However, in an alternate embodiment, the logic control circuit 128 might detect, via signaling with the base station transmitter 110, that the base station transmitter 110 is being supplied power from the power supply 101. Therefore, the logic control circuit 128 and switching transistor 118 together comprise control means for disabling the closing amplifier circuit 112, and removing the temporary closing current from the relay coil 144, when the relay contacts 146, 147 are closed. In addition, the logic control circuit 128 might periodically verify operation of the closing amplifier circuit 112 by enabling switching transistor 118 and measuring the voltage at upper sense terminal 160. If, during verification, the voltage at the upper sense terminal 160 approaches zero Volts, the logic control circuit 128 determines that the closing amplifier circuit 112 is operable and drawing the closing current.

To open, or reset, the relay device 103, the logic control circuit 128 enables switching transistor 120. When enabled, switching transistor 120 disables holding transistor 149 and removes the holding current from the relay coil 144, thereby opening the relay contacts 146, 147.

Operation of the base site 100 with both relay driver circuits 105, 106 operating collectively as a redundant relay driver circuit occurs as follows in accordance with the present invention. Both relay driver circuits 105, 106 operate independently as described above and, in addition, can independently establish the closing current through the relay coil 144. However, when both relay driver circuits 105, 106 operate together, two differences in operation arise compared to operation of a single relay driver circuit (e.g., 105). First, as shown in FIG. 1, the current-limiting resistor 108 is shared by both holding amplifier circuits 115, 116. Therefore, the total holding current through the relay coil 144 is split equally between the holding amplifier circuits 115, 116. Thus, when either logic control circuit 128, 142 verifies the holding current in its respective relay driver circuit 105, 106, the logic control circuit (e.g., 142) measures the voltages at both sense terminals 164, 166 of the current-sensing resistor 138 to determine whether the current flowing through the holding transistors 149, 153 is equivalent to the total desired holding current flowing through the relay coil 144. If the measured voltage at the upper sense terminal 164 is approximately equal to the voltage (e.g., 1.3 Volts) corresponding to one-half of the total desired holding current while the voltage at the lower sense terminal 166 is approximately zero, then the logic control circuit 142 determines that both holding means 108, 115, 126, 116, 140 and %the relay coil 144 are operable.

However, if the voltage at the upper sense terminal 164 corresponds to the voltage (e.g., 2.6 Volts) produced when the total holding current flows through a single holding amplifier circuit (e.g., 116) and the lower sense terminal 166 is approximately zero Volts, then either the holding amplifier circuit 115 or the bias resistor 126 of the other relay driver circuit 105 may be open-circuited. Further, if the voltages at both sense terminals 164, 166 correspond to the voltage produced when the total holding current flows through a single holding amplifier circuit (e.g., 115), then the holding transistor 153 of the measuring relay driver circuit 106 might be open-circuited. Still further, if the voltages at both sense terminals 164, 166 are approximately zero Volts, then the relay coil 144 or current-limiting resistor 108 might be open-circuited. In the preferred embodiment, the logic control circuits 128, 142 routinely (e.g., every few minutes) verify the holding currents of their respective relay driver circuits 105, 106.

In addition to passively monitoring the functionality of each holding amplifier circuit 115, 116 as described above, each logic control circuit 128, 142 might actively verify operation of its own relay driver circuit (e.g., 105) or the other driver circuit (e.g., 106). Verification of a single relay driver circuit's holding and closing currents by the logic control circuit (e.g. 128) is described above; however, active verification of the functionality of one relay driver circuit 106 by the other relay driver circuit's logic control circuit 128 occurs as follows. To verify operation of the holding amplifier circuit 116, logic control circuit 128 enables switching transistor 119, which disables the test holding amplifier circuit 116. The logic control circuit 128 then measures the voltage at the upper sense terminal 160 and, if the voltage at the Upper sense terminal 160 corresponds to the voltage (e.g., 2.6 Volts) produced when the total holding current flows through holding amplifier circuit 115 and the lower sense terminal 162 is approximately zero Volts, then the logic control circuit 128 determines that the test holding amplifier circuit 116 is functioning normally. However, if after disabling holding amplifier circuit 116, the logic control circuit 128 measures the same voltage at the upper sense terminal 160 as prior to disabling holding amplifier circuit 116 (e.g., 1.3 Volts), then the ! logic control circuit 128 might determine that the test holding amplifier circuit 116 is short-circuited.

"In the circumstance where the logic control circuit 128 determines that a holding amplifier circuit 115, 116 is inoperative, the logic control circuit 128 takes the inoperative holding amplifier circuit 115, 116 out of service. The logic control circuit 128 disables the inoperable holding circuit 115, 116 by inactivating all control to the inoperable holding circuit 115, 116. In different embodiments, higher levels of redundancy might be employed to provide further protection against single point failures. For example, the redundant relay driver circuit may employ redundant relay contacts (not shown) in series with set of contacts (146 or 147), thereby requiring that both the relay contacts and the set of contacts (146, 147) be enabled to control the relay device."

The second difference between the operation of the redundant relay driver circuit 105, 106 and a single relay driver circuit (e.g., 105) is that the procedure for opening the relay device 103 involves coordination between the relay driver circuits 105, 106. When the relay device 103 is to be opened, the logic control circuit 128, 142 of either relay driver circuit 105, 106 disables both holding amplifier circuits 115, 116 simultaneously by enabling switching transistors 119, 120 or switching transistors 133, 134, respectively. Enabling the selected pair of switching transistors (e.g., 119, 120) reduces the voltage at the control terminals of the holding transistors 149, 153 to the saturation voltages of the switching transistors 119, 120, thereby preventing the holding currents from flowing in each relay driver circuit 105, 106 and, Consequently, preventing the total holding current from flowing through the relay coil 144.

As described above, the present invention provides a technique for reducing the average continuous current flowing through a relay coil of a relay device. The present invention permits the current necessary to close the relay contacts of the relay device to flow through the relay coil only when the relay contacts need to be closed. Once the relay contacts are closed, the present invention reduces the current in the relay coil to the level necessary to maintain closure of the relay contacts. By contrast, prior art approaches require full relay closure current to flow at all times while the relay device is in operation. By reducing the current flowing through the relay coil after closure of the relay contacts, the present invention reduces the power dissipated in the relay coil and, therefore, improves the reliability of the relay coil. For example, if only one-half the current necessary to close the relay device is required to maintain closure of the relay device, the present invention reduces the power dissipated in the relay coil by a factor of four. This reduction in power dissipated in the relay coil can, depending on the particular relay coil, increase the mean-time-to-failure of the relay coil by a factor of at least ten when compared to maintaining full closure current through the relay coil as in the prior art. In addition to improving the reliability of the relay coil, the present invention improves reliability of the relay driver circuitry by providing redundant relay driver circuits that allow one of the relay driver circuits to be removed without any change in relay state (i.e., closed relay device remains closed). Further, the redundant relay driver circuits of the present invention are configured and controlled such that each relay driver circuit can verify operation of the other without affecting the relay state.

FIG. 2 illustrates a logic flow diagram 200 of steps executed to close and maintain closure of a relay device in accordance with the present invention. The logic flow begins (201 ) when a holding circuit coupled to the relay coil of the relay device establishes (203) a holding current through the relay coil. As discussed above, the holding current is not sufficient to close the set of relay contacts, but is sufficient to maintain closure of the relay contacts after the relay contacts have been closed. Once the holding current has been established, a closing circuit establishes a temporary closing current through the relay coil, such that the holding current and the closing current together are at least sufficient to close the relay contacts. In a preferred embodiment, the holding current is approximately one-half the current necessary to close the relay contacts; whereas, the closing current is greater than the holding current and preferably equal to the current necessary to close the relay contacts. In an alternate embodiment, the closing current might be less than the holding current provided the sum of the holding current and the closing current is at least sufficient to close the relay contacts.

Upon establishing the closing and holding currents through the relay coil, a control circuit determines (207) whether the relay device is indeed closed. For example, the control circuit might verify that a circuit (e.g., a base station transmitter) coupled to a power supply via the relay device is receiving power. If the relay device is not closed, the control circuit instructs the closing circuit to re-establish (205) the closing current. However, if the relay device is closed, the control circuit instructs the closing circuit to remove (209) the closing current. Thus, the closing current is only used temporarily to close the relay contacts. The closing current is preferably removed by disabling a transistor in the closing circuit that is coupled to the relay coil and drawing the closing current.

Once the closing current is removed, the control circuit determines (211) whether the relay device should be kept closed. When the relay device is to remain closed, the holding circuit maintains the holding current through the relay coil and the logic flow ends (213). However, when the relay device is to be opened and reset, the control circuit instructs the holding circuit to remove (215) the holding current from the relay coil and the logic flow ends (213). Similar to removing the closing current, the holding current is preferably removed by disabling a transistor in the holding circuit that is coupled to the relay coil and drawing the holding current.

The present invention provides an apparatus and method for controlling a relay device having a coil and a set of contacts. With this invention, reliability of a relay coil is improved by reducing the average current flowing through (and, consequently, the average power dissipated in) the relay coil. The present invention permits full closure current to flow through the relay coil only when necessary to close the relay contacts, as opposed to the continuous flow of full closure current through the relay coil as in the prior art. In addition to improving the reliability of the relay coil, the present invention improves reliability of the relay driver circuitry by providing redundant relay driver circuits that verify each other's operation and allow one of the relay driver circuits to be removed without a change in relay state.

While the present invention has been particularly shown and described with reference to a particular embodiment thereof, it will be understood by those skilled in the art that various changes in form and details may be made therein without departing from the spirit and scope of the present invention.

What I claim is:

1. A redundant relay driver circuit for controlling a relay device having a coil and a set of contacts, the coil having a first terminal coupled to a power supply, the redundant relay driver circuit comprising:

first holding, means, coupled to a second terminal of the coil, for establishing a first, current through the coil;

second holding means, coupled to the second terminal of the coil, for establishing a second current through the coil;

closing means, coupled to the second terminal of the coil, for establishing a third current through the coil, the first current, the second current, and the third current together being sufficient to at least close the set of contacts, and the first current and the second current together being sufficient to maintain closure of the set of contacts; and control means, coupled to the closing means, the first holding means, and the second holding means, for disabling the closing means when the set of contacts are closed, for testing operability of the first holding means and the second holding means, and for disabling either holding means when either holding means is inoperable.

2. The redundant relay driver circuit of claim 1, wherein the first holding means comprises:

a first resistance device having a first terminal and a second terminal, the first terminal of the first resistance device being coupled to the second terminal of the coil;

a first amplifying device having a supply terminal, a return terminal, and a control terminal, the supply terminal of the first amplifying device being coupled to the second terminal of the first resistance device and the return terminal of the first amplifying device being coupled to a signal return; and a second resistance device having a first terminal and a second terminal, the first terminal of the second resistance device being coupled to the power supply and the second terminal of the second resistance device being coupled to the control terminal of the first amplifying device.

3. The redundant relay driver circuit of claim 2, wherein the second holding means comprises:

the first resistance device;

a second amplifying device having a supply terminal, a return terminal, and a control terminal, the supply terminal of the second amplifying device being coupled to the second terminal of the first resistance device and the return terminal of the second amplifying device being coupled to the signal return; and a third resistance device having a first terminal and a second terminal, the first terminal of the third resistance device being coupled to the power supply and the second terminal of the third resistance device being coupled to the control terminal of the second amplifying device.

4. A base site comprising:

a base station transmitter;

a relay device, coupled to the base station transmitter, including a coil and a set of contacts, the relay device supplying current to the base station transmitter when the set of contacts are closed, the coil having a first terminal coupled to a power supply; and a redundant relay driver circuit, coupled to the relay device, for drawing current through the coil to close, and maintain closure of, the set of contacts, the redundant relay driver circuit comprising:

holding means, coupled to a second terminal of the coil, for establishing a first current through the coil;

closing means, coupled to the second terminal of the coil, for establishing a second current through the coil, the first current and the second current together being at least sufficient to close the set of contacts, and the first current being sufficient to maintain closure of the set of contacts; and control means, coupled to the closing means and the holding means for disabling the closing means when the set of contacts are closed and for disabling holding means when holding means is inoperable.

* * * * *